United States Patent [19]

Checki

[11] Patent Number: 4,876,072

[45] Date of Patent: Oct. 24, 1989

[54] CATALYTIC CONVERTER WITH SCREEN ENCLOSURE HOLDING PELLETS UNDER TENSION

[76] Inventor: Edward T. Checki, 4747 Highway H, Franksville, Wis. 53126

[21] Appl. No.: 194,334

[22] Filed: May 16, 1988

[51] Int. Cl.[4] ..... F01N 3/10

[52] U.S. Cl. ..... 422/179; 422/190; 422/211; 422/221; 60/299; 60/302

[58] Field of Search ..... 422/177, 179, 190, 211, 422/221; 60/299, 302

[56] References Cited

U.S. PATENT DOCUMENTS

| | | | |
|---|---|---|---|
| 2,185,584 | 1/1940 | Boyce | 183/49 |
| 3,449,086 | 6/1969 | Innes . | |
| 3,817,716 | 6/1974 | Betz . | |
| 3,867,105 | 2/1975 | Wagner . | |
| 3,925,252 | 12/1975 | Yabuta et al. | 422/177 X |
| 3,960,509 | 6/1976 | Abriany . | |
| 4,105,414 | 8/1978 | Garcea | 422/177 |
| 4,106,913 | 8/1978 | Bunda et al. | 422/180 |
| 4,251,487 | 2/1981 | Goedicke | 422/179 |
| 4,338,284 | 7/1982 | Ignoffo | 422/171 |
| 4,385,031 | 5/1983 | Fratzer et al. | 422/176 |
| 4,457,895 | 7/1984 | Prigent | 422/179 |
| 4,576,799 | 3/1986 | Worner et al. | 422/176 |
| 4,682,470 | 7/1987 | Shaff | 422/179 X |

*Primary Examiner*—Barry S. Richman
*Assistant Examiner*—Lynn M. Kummert
*Attorney, Agent, or Firm*—Peter N. Jansson, Ltd.

[57] ABSTRACT

A catalytic converter including within the housing a pellet enclosure which is of resilient screen, the enclosure compressing the body of pellets such that the pellets are held firmly in place under tension. The screen enclosure is compressed by the housing to increase tension on the body of pellets. In preferred embodiments the screen enclosure and body of pellets are tubular, with one edge compressed inwardly by a tubular housing. The screen enclosure and body of pellets are preferably tapered.

15 Claims, 2 Drawing Sheets

CATALYTIC CONVERTER WITH SCREEN ENCLOSURE HOLDING PELLETS UNDER TENSION

FIELD OF THE INVENTION

This invention is related generally to catalytic converters and, more particularly, to catalytic converters of the type having a body of pellets in a flow-through housing.

BACKGROUND OF THE INVENTION

Automotive catalytic converters of the pellet (or "bead") type are currently sheet steel structures which sandwich and support a bed of ceramic pellets coated with a catalyst, usually a noble metal. Typically the pellets are contained between a pair of perforated sheet steel retainers which define the bed. The bed is arranged within a container so that hot engine exhaust gases must pass over, down and through the catalyst pellet bed. The gases then exit the converter in a less noxious state.

Many configurations of pellet beds and container housings have been developed and used and numerous improvements have been made, particularly since catalytic converters became essential equipment on automotive engines. However, automotive catalytic converters continue to have significant problems, some of which have led to costly recalls in the automotive industry. Improvements are needed for better functioning and longer, more reliable life in such devices.

Catalytic converters must survive the turbulent hot exhaust stream and complete the combustion of the gases, preferably without adding undue backpressure in the exhaust system. In use, particularly at hot operating temperatures, exhaust flow can agitate, swirl and grind the ceramic pellets to dust. This action in the pellet bed, sometimes referred to as pellet fluidization, is most harmful to operation of the catalytic converter.

The primary approach in current catalytic converter design to retarding pellet fluidization involves supporting the body of pellets ("pellet bed") in a rigid manner. Heavy stainless steel retainers which are pinned by thick steel studs fix the geometry of the bed. However, the thermal cycling and vibration which are inherent in the operation of an automobile provide room for the pellets within the bed to agitate. Over time, voids appear, louvers plug with worn pellets, and the function of the converter deteriorates. The conversion efficiency of the unit declines and backpressure increases over the life of the converter.

Current catalytic converter designs have failed to hold the pellets reliably in tension and prevent fluidization in the pellet bed. One example of such failure is the well-known dual bed pellet converter, the upper bed of which often has extreme fluidization. This design has been dropped. The multi-million dollar recall programs in the auto industry attest to the inability of current designs to completely overcome catalytic converter problems. Such problems remain unsolved.

Another continuing concern with catalytic converters is the fact that excessive backpressure reduces engine efficiency and performance. Reducing backpressure without harming emission control is a continuing industry goal.

Yet another concern is the degree of unacceptable emissions during the start-up phase of engine operation, due to slow "light-up."Faster light-up is desirable.

There is a long-standing need for improved practical catalytic converters for the automotive industry.

OBJECTS OF THE INVENTION

It is an object of this invention to provide an improved catalytic converter overcoming problems and shortcomings of the prior art.

Another object of this invention is to provide a catalytic converter with improved life and improved efficiency during long use.

Another object of this invention is to provide a converter with improved resistance to pellet fluidization.

Another object of this invention is to provide a converter which holds the body of pellets reliably in tension to avoid or minimize pellet fluidization.

Another object is to provide catalytic converters with reduced backpressure and faster light-off.

These and other important objects will be apparent from the descriptions of this invention which follow.

SUMMARY OF THE INVENTION

This invention is an improved catalytic converter overcoming certain problems and shortcomings of the prior art, including those mentioned. The catalytic converter of this invention is of the type having a body of pellets, such as ceramic pellets, within a flow-through housing.

To overcome the failure of current designs, the converter of this invention maintains pellet tension in the body of pellets by holding the pellets firmly in an enclosure of high-temperature wire mesh or screen. The primary attributes of such a screen enclosure are its resiliency and memory over the temperature range found within a catalytic converter with the engine at full throttle. By virtue of screen resiliency and the packing of pellets in the enclosure, the enclosure compresses the body of pellets to hold them firmly in tension.

Rigid means, preferably the inner wall of the converter housing itself, adds compression on the outer wall of the screen enclosure. The housing preferably encircles the screen enclosure, compressing its outer walls inwardly. This increases the tension on the body of pellets and thus helps to prevent pellet fluidization.

A preferred embodiment of this invention includes a configuration which serves to avoid excessive backpressure yet still maintain excellent pellet tension. In such configuration, the housing includes a tubular wall and first and second opposed housing ends, each with a flow opening, and the screen enclosure and the body of pellets it encloses are tubular in the manner hereafter described.

The tubular screen enclosure has an outer surface with opposed first and second edges at its ends, the first edge being in flow-restricting engagement with the tubular wall near the housing first end. The tubular housing wall and the screen enclosure outer surface form a flow channel outside the enclosure extending from near the first edge to the second edge. This configuration gives low backpressure during operation, thus increasing operating efficiency. Reliable fast light-off is provided as well.

The outer flow channel must have sufficient space, between the outer wall of the screen enclosure and the housing, to provide good gas flow. Untreated gas should flow freely before passing through the pellet body and treated gas should flow freely after passing through the pellet body. The thickness of the pellet body (or "bed") and the length of the body of pellets are functions of the desired gas-flow characteristics, the noxious gas concentration, and the noble metal or other catalyst loading of the pellets.

In highly preferred embodiments of such tubular structure, the screen enclosure is compressed by its engagement with the tubular wall of the housing near the first end of the housing to an extent that such screen-with-housing engagement extends for a distance from the first edge and substantially reduces the cross dimension of the outer surface of the screen enclosure in that area. This serves to increase the tension on the body of pellets throughout the screen enclosure.

Such screen-with-housing engagement most preferably extends for a distance from the first end at least equal to the tubular pellet body thickness. This provides ample compression, and also serves to provide a sufficient distance of gas flow through every portion of the body of pellets to prevent untreated or insufficiently treated gas from bypassing the bed.

In certain highly preferred embodiments, the tubular screen enclosure is tapered. Its first edge has a greater cross-dimension than its second edge. This design tends to facilitate construction. The housing is preferably cylindrical for the same reason, with the body of pellets being of frusto-conical shape.

In certain preferred embodiments, the tubular screen enclosure is sock-like in shape, such that the tubular pellet body is closed near the second edge. Thus, flow through the pellet body can be radial, through a lateral portion of the body, or axial, through the end portion.

In such most preferred sock-l exhaust gas can flow in either direction through the housing—either from the outside of the sock in or from the inside of the sock out. However, backpressure is generally lower when the exhaust is channeled from the inside out—that is, first to the center of the sock-like structure through the open end and from there passing either radially through the walls of the structure or axially through the end.

Given the hot hurricane of exhaust gas from an engine at full throttle and under load, the tubular body of pellets presents a large frontal area of catalyst pellets all held in tension. Uniform bed depth and the absence of voids tends to evenly distribute the flow throughout the element. Hot spots are avoided. The unit will not clog or fluidize. The resilient screen enclosure and overall configuration serve to avoid collapse of the pellet bed.

In summary, excellent flow characteristics and reliability are provided, and efficient operation and overall catalytic converter life are extended.

DETAILED DESCRIPTIONS OF PREFERRED EMBODIMENTS

Figure 1:
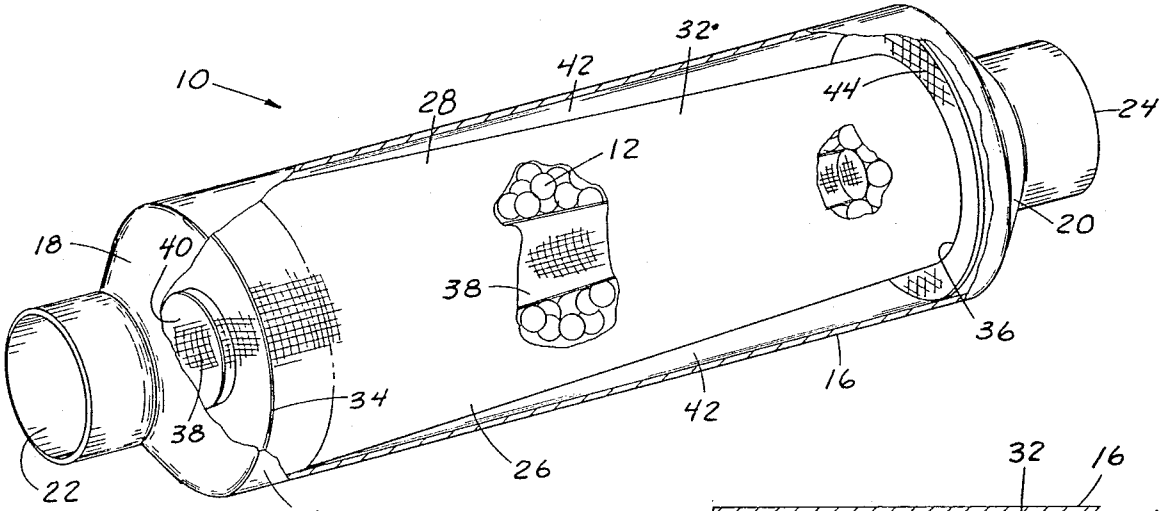
FIG. 1 is a perspective view of a preferred catalytic converter in accordance with this invention, with breakaways to illustrate internal portions.

The figures illustrate the improved catalytic converter 10 in accordance with a preferred embodiment of this invention, including a body of pellets 12 inside a container housing 14.

Container housing 14 includes a tubular wall 16 and first and second opposed housing ends 18 and 20 which form flow openings 22 and 24, respectively. Catalytic converter 10 is designed such that exhaust gases flow into one of the openings 22 and 24, through the body of pellets 12, and ut through the other flow opening.

A screen enclosure 26 is inside housing 14 and serves to enclose and define a pellet body 12. Both screen enclosure 26 and pellet body 12 are sock-like in shape; that is, they have tubular lateral areas 28, are open at one end, and closed at the other by an end 30. The tubular area and end of the pellet body are of substantial thickness (for example, 3 cm) to provide a good mass of pellets through which exhaust must pass.

Screen enclosure 26 has a tubular outer surface 32 which has opposed first and second edges 34 and 36. Screen enclosure 26 also has an inner surface 38 forming an axial void inside flow channel 40. Inside flow channel 40 extends for most of the length of screen enclosure 2 First edge 34 has a cross-dimension which is greater than the cross-dimension of second edge 36. Screen enclosure 26, in particular its outer surface 32, is frusto-conical in shape, while tubular housing wall 16 is cylindrical.

First edge 34 of outer surface 32 of screen enclosure 26 is in flow-restricting engagement with housing wall 16. Pellet body 12 is compressed by screen enclosure 26 such that the pellets are each held firmly in place under tension. Such in-tension condition is by virtue of the tight packing of pellet body 12 and the resilient characteristic of screen enclosure 26.

Figure 3:
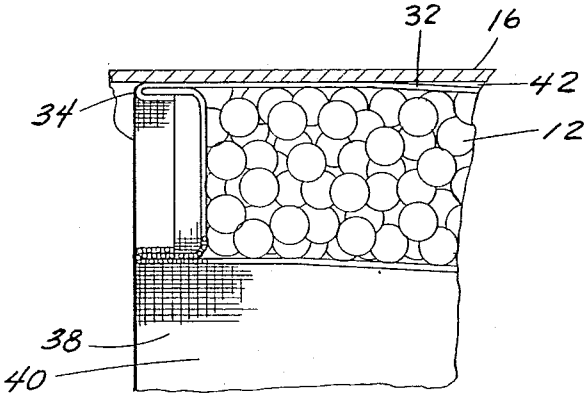
FIG. 3 is an enlarged fragmentary sectional view illustrating details of an area of engagement of the screen enclosure with the housing wall.
Figure 2:
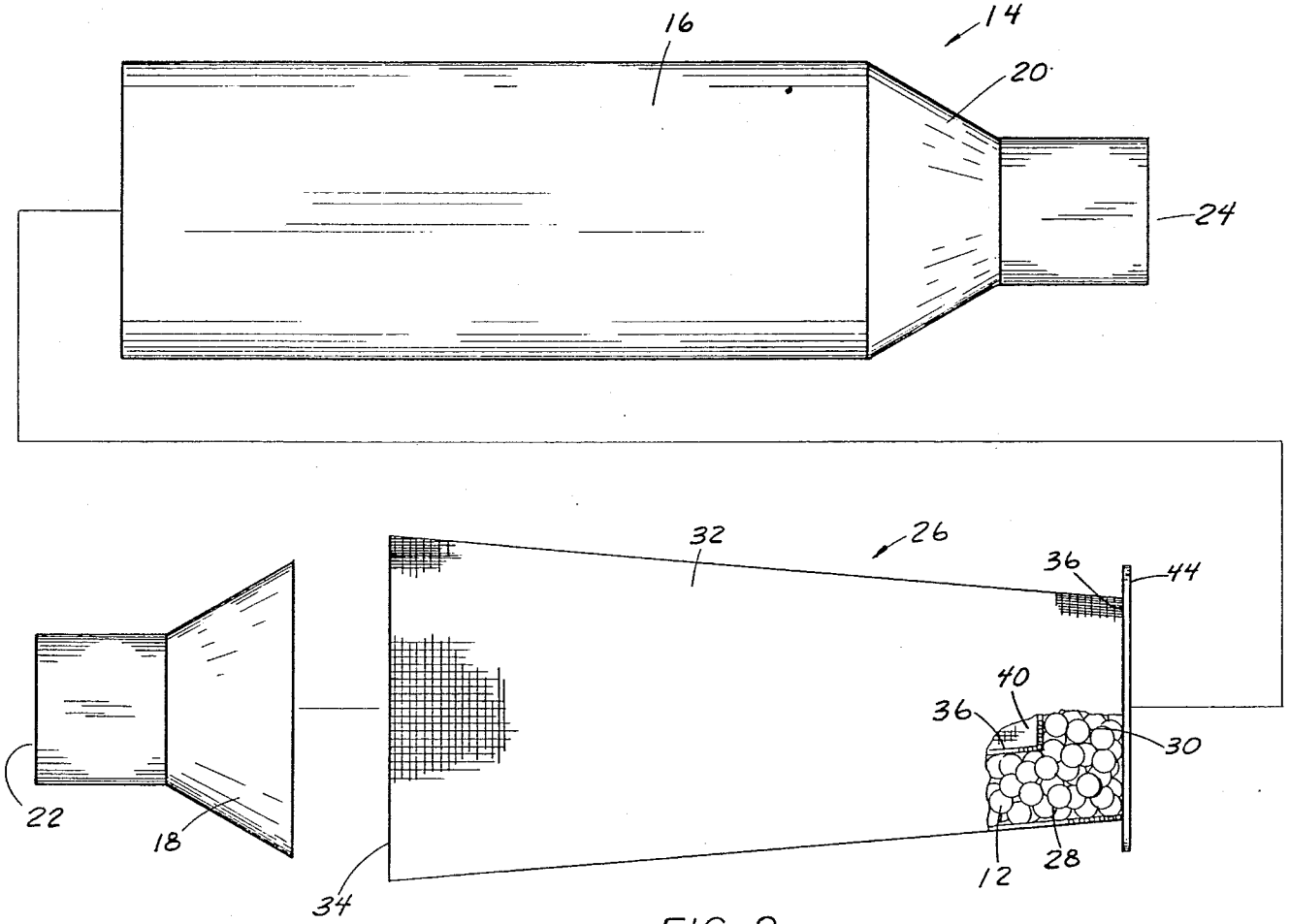
FIG. 2 is an unassembled side elevation with a cutaway portion.

FIG. 2 illustrates that, before screen enclosure 26 with its pellet body 12 is inserted into housing 14, the cross-dimension (diameter) of first edge 34 is greater than the inner diameter of tubular housing wall 16. When screen enclosure 26 is inserted into housing 14, screen enclosure 26 is compressed radially inwardly in an near first edge 34, as illustrated in FIGS. 1 and 3. The phantom line in FIG. 1 marks the end of the area of engagement of screen enclosure 26 with housing wall 16.

Tubular wall 16 provides a rigid means which compresses screen enclosure 26 in such area of engagement. Such engagement of outer surface 32 with housing wall 16, which encircles screen enclosure 26, extends from first edge 32 for a distance in excess of the thickness of pellet body 12. This results in a substantial reduction in the outer dimension of outer surface 32 in this location, which significantly increases the tension on pellet body 12. The resilient characteristic of screen enclosure 26 serves, by virtue of such compression, to provide the added tension. This further reduces the possibility of pellet vibration and movement which could lead to fluidization in the pellet body.

Tubular housing wall 16 and outer surface 32 of screen enclosure 26 together form an outside flow channel 42 which extends from the area of engagement of outer surface 32 with housing all 16 all the way to second edge 36 of outer surface 32, at the other end of screen enclosure 26. Outer surface 32, inner surface 38, inside flow channel 40, and outside flow channel 42 are tapered. Outside flow channel 42 is wider where the diameter of screen enclosure 26 is narrower.

Screen enclosure 26 is secured at second edge 36 of outer surface 32 to a locator ring 44. Locator ring 44 is itself made of a heavy screen material such that gases may flow easily through it to second housing end 20 and flow opening 24. The outer edge of locator ring 44 engages tubular housing wall 16, and an inner edge engages second edge 36 of screen enclosure outer surface 32.

First and second housing ends 18 and 20 are tapered to provide plenums at each end of screen enclosure 26. Exhaust gas may flow through catalytic converter 10 in either direction, as earlier indicated, but flow is preferred from first end 18 to second end 20.

During such flow, exhaust gas enters flow opening 22 into the adjacent plenum. From that point exhaust gas may enter the annular end of screen enclosure 26 or, more likely, flow into inside flow channel 40. Such gas then flows either radially through the thickness of screen enclosure 26 and pellet body 12 or axially through end 30 of screen enclosure 26 and pellet body. Gases reaching outside flow channel 42 then flow through locator ring 44 into the plenum adjacent flow opening 24 and from there exit catalytic converter 10 through opening 24.

Catalytic converter 10 is preferably made out of metal such as steel, all as well known to those skilled the catalytic converter art. Screen enclosure 26 may be made of a wide variety of suitable screen materials, provided they are able to withstand the high temperatures within the catalytic converter and further provided they exhibit suitable resilience at such temperatures. Suitable materials include an alloy known by the trademark Inconel 601 and another alloy known as #304 stainless. In a highly preferred form, each square inch of the screen material has 10 strands of wire, having a diameter of 0.032 inch, running in crossing perpendicular directions.

The term "resilient" as used herein in describing will the screen enclosure means that the screen material not readily deform permanently, but will instead provide increasing tension due to its spring-back characteristics.

In constructing screen enclosure 26, normal screen working methods may be used. Seams may be periodic spot welds spaced, for example, every inch or so.

The pellets which are used may be typical ceramic catalytic converter pellets bearing catalytic materials such as the noble metals. This invention does not i new pellet materials.

While screen enclosure 26 is mounted within housing 14 in a concentric manner, it may sag to some extent along its length at positions between first and second housing ends 18 and 20 during high temperature use. Such sag tends to further increase the tension on pellet body 12, which in turn tends to maintain a firm arrangement of pellets in screen enclosure 26.

While the principles of this invention have been described in connection with specific embodiments, it should be understood clearly that these descriptions are made only by way of example and are not intended to limit the scope of the invention.

I claim:

1. In a catalytic converter of the type with a body of pellets in a housing, the improvement comprising an enclosure within the housing made of resilient screen, the screen enclosure compressing the body of pellets such that the pellets are held firmly in place under tension.

2. The catalytic converter of claim 1 wherein the pellets are ceramic.

3. The catalytic converter of claim 1 further including rigid means compressing the screen enclosure to increase the tension on the body of pellets.

4. The catalytic converter of claim 3 wherein the rigid compressing means is the housing.

5. The catalytic converter of claim 4 wherein the housing encircles the screen enclosure and reduces its outer dimension.

6. The catalytic converter of claim 5 wherein the pellets are ceramic.

7. The catalytic converter of claim 1 wherein:

the housing includes a tubular wall and first and second opposed housing ends with flow openings;

the screen enclosure is tubular, has an outer surface with opposed first and second edges, and defines the body of pellets as a tubular body;

the first edge of the enclosure outer surface is in the first edge of the enclosure outer surface is in flow-restricting engagement with the tubular wall near the housing first end: an the tubular housing wall and screen enclosure outer surface form a flow channel outside the enclosure which extends from near the first edge to the second edge, whereby backpressure is low during operation.

8. The catalytic converter of claim 7 wherein the tubular screen enclosure is compressed by its engagement with the tubular wall near the housing first end to an extent that such engagement extends for a distance from the first edge, substantially reducing the cross dimension of the outer surface and increasing the tension on the body of pellets.

9. The catalytic converter of claim 8 wherein the engagement distance at least equals the tubular pellet body thickness.

10. The catalytic converter of claim 7 wherein the tubular screen enclosure is tapered, the first edge having a greater cross-dimension than the second edge.

11. The catalytic converter of claim 10 wherein the tubular screen enclosure and tubular pellet body are closed near the second edge, thereby allowing some gas flow through the pellet body in an axial direction.

12. The catalytic converter of claim 11 wherein:

the housing is cylindrical of given inner diameter; and the screen enclosure and pellet body frusto-conical, the first edge of the outer surface having a cross-dimension compressed to the given inner diameter.

13. The catalytic converter of claim 12 wherein the tubular screen enclosure is compressed by its engagement with the tubular wall near the housing first end to an extent that such engagement extends for a distance from the first edge, substance outer dimension of the outer surface and increasing the tension on the body of pellets.

14. The catalytic converter of claim 13 wherein the engagement distance at least equals the tubular pellet body thickness.

15. The catalytic converter of claim 14 wherein the pellets are ceramic.

* * * * *

UNITED STATES PATENT AND TRADEMARK OFFICE

CERTIFICATE OF CORRECTION

PATENT NO. : 4,876,072

DATED : October 24, 1989

INVENTOR(S) : Edward T. Checki

It is certified that error appears in the above-identified patent and that said Letters Patent is hereby corrected as shown below:

In column 3, line 31, change "sock-l" to --sock-like configurations,--.

In column 4, line 4, change "ut" to --out--.

In column 4, line 18, change "2" to --26.--.

In column 4, line 57, change "housing all" to --housing wall--.

In column 5, line 33, delete the word "will".

In column 5, line 34, before the word "not" insert --will--.

In column 5, line 38, after "may be" insert --formed with--.

In column 5, line 42, change "i new" to --involve new--.

UNITED STATES PATENT AND TRADEMARK OFFICE

CERTIFICATE OF CORRECTION

PATENT NO. : 4,876,072

DATED : October 24, 1989

INVENTOR(S) : Edward T. Checki

It is certified that error appears in the above-identified patent and that said Letters Patent is hereby corrected as shown below:

In claim 1, line 2, before "pellets" insert --catalytic converter--.

In claim 1, line 4, after "enclosure" insert --surrounding, entirely enclosing, and--.

In claim 7, change the 3rd subparagraph which starts "the first edge" to read as follows:

--The first edge of the enclosure outer surface is in flow-restricting engagement with the tubular wall near the housing first end; and--

In claim 12, line 3, after "body" insert --are--.

In claim 13, line 5, delete "substance" and insert --substantially reducing the--.

Signed and Sealed this

Eighth Day of January, 1991

*Attest:*

HARRY F. MANBECK, JR.

*Attesting Officer*

*Commissioner of Patents and Trademarks*